US005094567A

United States Patent [19]

Nista et al.

[11] Patent Number: 5,094,567

[45] Date of Patent: Mar. 10, 1992

[54] FLEXIBLE COLUMN FROM COMPOSITE MATERIAL

[75] Inventors: Alessio Nista, Spinea; Michael Trimming, Montemarcello-Ameglia; Martino Vecchio, Milan; Domenico Spirito, Marina Di Carrara, all of Italy

[73] Assignees: Techocompositi S.p.A., Milan; Tecnomare S.p.A., Venice, both of Italy

[21] Appl. No.: 643,098

[22] Filed: Jan. 22, 1991

Related U.S. Application Data

[63] Continuation of Ser. No. 341,252, Apr. 20, 1989, abandoned, which is a continuation of Ser. No. 10,636, Feb. 4, 1987, abandoned.

[30] Foreign Application Priority Data

Feb. 5, 1986 [IT] Italy ..... 19301 A/86

[51] Int. Cl.[5] ..... E02B 17/00

[52] U.S. Cl. ..... 405/227; 405/195.1; 405/204; 405/224

[58] Field of Search ..... 405/204, 203, 202, 195, 405/207, 224, 227; 156/173; 264/257; 425/63, 64

[56] References Cited

U.S. PATENT DOCUMENTS

| | | | |
|---|---|---|---|
| 4,048,943 | 9/1977 | Gerwick | 405/211 X |
| 4,089,719 | 5/1978 | Sundell | 156/173 X |
| 4,278,485 | 7/1981 | Hamm et al. | 156/173 |
| 4,371,325 | 2/1983 | Harbison | 425/63 |
| 4,380,523 | 4/1983 | Lind et al. | 156/173 X |
| 4,543,014 | 9/1985 | Brandi et al. | 405/202 X |
| 4,589,801 | 5/1986 | Salama | 405/224 |
| 4,622,086 | 11/1986 | Pück et al. | 156/169 X |
| 4,634,314 | 1/1987 | Pierce | 405/195 |
| 4,741,648 | 5/1988 | Einstabland et al. | 405/204 X |
| 4,778,308 | 10/1988 | Stove | 405/204 |

FOREIGN PATENT DOCUMENTS

| | | | |
|---|---|---|---|
| 93012 | 11/1983 | European Pat. Off. . | |
| 2069975 | 9/1971 | France . | |
| 1305198 | 1/1973 | United Kingdom . | |
| 2017260 | 10/1979 | United Kingdom . | |
| 2051304 | 1/1981 | United Kingdom . | |
| 2109325 | 6/1983 | United Kingdom . | |
| 2139677 | 11/1984 | United Kingdom | 405/204 |

*Primary Examiner*—Dennis L. Taylor
*Attorney, Agent, or Firm*—Morgan & Finnegan

[57] ABSTRACT

Flexible column for offshore applications made from a composite material consisting or consisting essentially of a thermosetting resin reinforced with natural, artificial or synthetic fibers.

9 Claims, 1 Drawing Sheet

FLEXIBLE COLUMN FROM COMPOSITE MATERIAL

This is a continuation of co-pending application Ser. No. 07/341,252, filed on Apr. 20, 1989, now abandoned, which is a continuation application of Ser. No. 07/010,636, filed Feb. 4, 1987, now abandoned.

DESCRIPTION OF THE INVENTION

The present invention relates to a flexible column made from a composite material.

More particularly, the present invention relates to a flexible column made from a composite material for offshore applications.

By the term "offshore applications", as used in the present description and claims, all the industrial and non-industrial applications are intended characterized by the fact that they are installed in the sea, as ship moorings, either permanent or temporary, perforation or well drilling offshore platforms, production, control offshore platforms, admission towers for submarine plants, etc.

It is known that in the offshore field there are many applications among which the most important is the hydrocarbon extraction from the sea bottom. For this application it is necessary to perform both a seismic and a perforation exploration activity, extraction of the hydrocarbon, and conveyance to dry land. The most characteristic non-industrial applications are those relating to the study of the ambient sea and search of the sea bottom and foundation.

For all the above-mentioned applications, it is known from U.K. Patents 2,102,482 and 2,123,883 and from Italian Patent application 84 116 A/83, filed on May 9, 1983, to use monolithic or reticular structures made from steel, titanium or reinforced concrete. Said monolithic or reticular structures generally involve a plinth and an attached vertical empty column which extends from said plinth, the bending strength modulus of which decreases from the plinth towards the top of the column.

Generally, these types of offshore structures may involve the use of a buoyancy chamber placed in the upper part of the column, the purpose of which is to generate a recall or reactive force when the column is shifted from its equilibrium position.

The configuration, the construction technique, and the performance of the above-mentioned monolithic structures are different according to various parameters such as for instance the depth of the water, meterooceanograhic conditions, working and environmental loads, etc.

The known monolithic or recticular structures show a series of drawbacks which limit their application. Thus, for instance, steel structures require anti-corrosion protection and show some difficulties during the sea-positioning step because of the weight and size of the structure, the necessity to carry out inspections and repairing imposed by the material employed, etc. These drawbacks might be partically overcome by using titanium; this material, however, shows the drawback of being very expensive.

Furthermore, for applications at low and medium depths, such as for instance those lower than 300 meters, said structures cannot be used because of their poor flexibility, whereas, for greater depths, installation problems arise, which can be solved by particular techniques involving the use of mechanical connections. However, these mechanical connections require a continuous control and maintenance so that inspection is necessary and substitution in the event of faulty performance. Furthermore, the control of joints, as the depth increases, becomes more and more difficult and expensive.

It has been now found, and this is the object of the present invention, that the above-mentioned drawbacks may be readily overcome by using a flexible column made from a composite material consisting or consisting essentially of a thermosetting resin reinforced with natural, artificial or synthetic fibers.

The flexible column of the present invention may be empty or solid and may be provided, preferably in the upper part, with a buoyancy chamber of the same composite material.

Said column is particularly useful at low and medium depths such as for instance up to 300 meters, in that the physico-mechanical characteristics of the composite material are such as to allow displacements towards heights greater than those which can be reached when using other known materials such as steel, titanium, reinforced concrete, etc. In this way it is possible to take advantage of the intervention of the buoyancy chamber which produces the necessary recoil strength.

The column of the present invention may be used at any depth. It does not require the use of mechanical joints or other moving parts and does not require a continuous anti-corrosion treatment.

Furthermore, the use of composite materials allows one to obtain structures lighter than the analogous structures of the prior art, thus lowering the weight by up to 70%.

The column is fastened to the sea bottom by means of known techniques, according to the depth, such as for instance by means of gravity bed plates or by means of metallic recticular piling structures, etc.

To the buoyancy chamber a structure may be connected preferably also made from a composite material, emerging out of the sea surface wherein suitable instruments and devices are appropriately placed in order to make the column itself fully functional for the desired purpose. Thus, for instance, when a mooring column is used, dock means for ships are placed in said structure together with regulation and distribution devices for the crude oil.

Thermostating resins useful for constructing the column of the present invention are selected from among unsaturated polyester resins or vinyl ester resins, epoxy and polyurethane resins, etc. Unsaturated polyester resins such as, for instance, bis-phenolic and isophthalic resins are preferred.

Fibers may be made of glass, rock, carbon, acrylic, aramidic polymers such as Kevlar, etc. Glass fibers are preferred in that they impart the best elasticity to the composite material for this type of structure and because of the cost/performance ratio.

The above-mentioned fibers may be used as such or in the form of tissue. Fibers may be in the form of staple or continuous yarn, randomly arranged or preferably, in bundles of vertical, unidirectional monofilaments without continuity and held together by filaments helicoidally wrapped around them.

Any fiber/resin ratio by weight may be used for the preparation of the composite material to be used for building the column of the present invention, such as ratios by weight between 80/20 and 20/80, and preferably between 60/40 and 40/60.

The preparation of the composite material is according to known techniques, by automatic or semiautomatic systems of impregnation and deposition on preformed molds as pre se well known in the art.

The column has an outside diameter and a thickness depending on the depth of the sea and on the stresses which the column must bear. In any case, outside diameters between 0.5 and 10 meters are sufficient to cover a depth range of up to 2,000 meters.

If a hollow column is used within the same depth range, wall thicknesses between 2 and 100 cm are preferred.

The column is generally tapered in such manner that its outside diameter increases from the surface to the bottom.

The buoyancy chamber, which generally is located on the column some meters under the sea surface, has a shape and volume depending on the depth and on the stresses which normally act on the column. In any case, it is preferable to provide a thrust chamber the volume of which insures a buoyancy which, together with the elasticity of the composite material of the structure, tends to balance any flexion of the column due to outside forces.

Spherical or cylindrical buoyance chambers having an external diameter between 1.5 and 5 times the external diameter of the column are preferred.

As the buoyance chamber also must bear high stresses, it is built with thicknesses of the same order of size as those of the cylinder, although thicknesses between 2 and 50 cm are preferred.

BRIEF DESCRIPTION OF THE DRAWINGS

An illustrative, but not limitative, flexible column of the present invention is illustrated in the accompanying drawings, wherein.

DETAILED DESCRIPTION OF THE INVENTION

Figures 1, 2, 3:
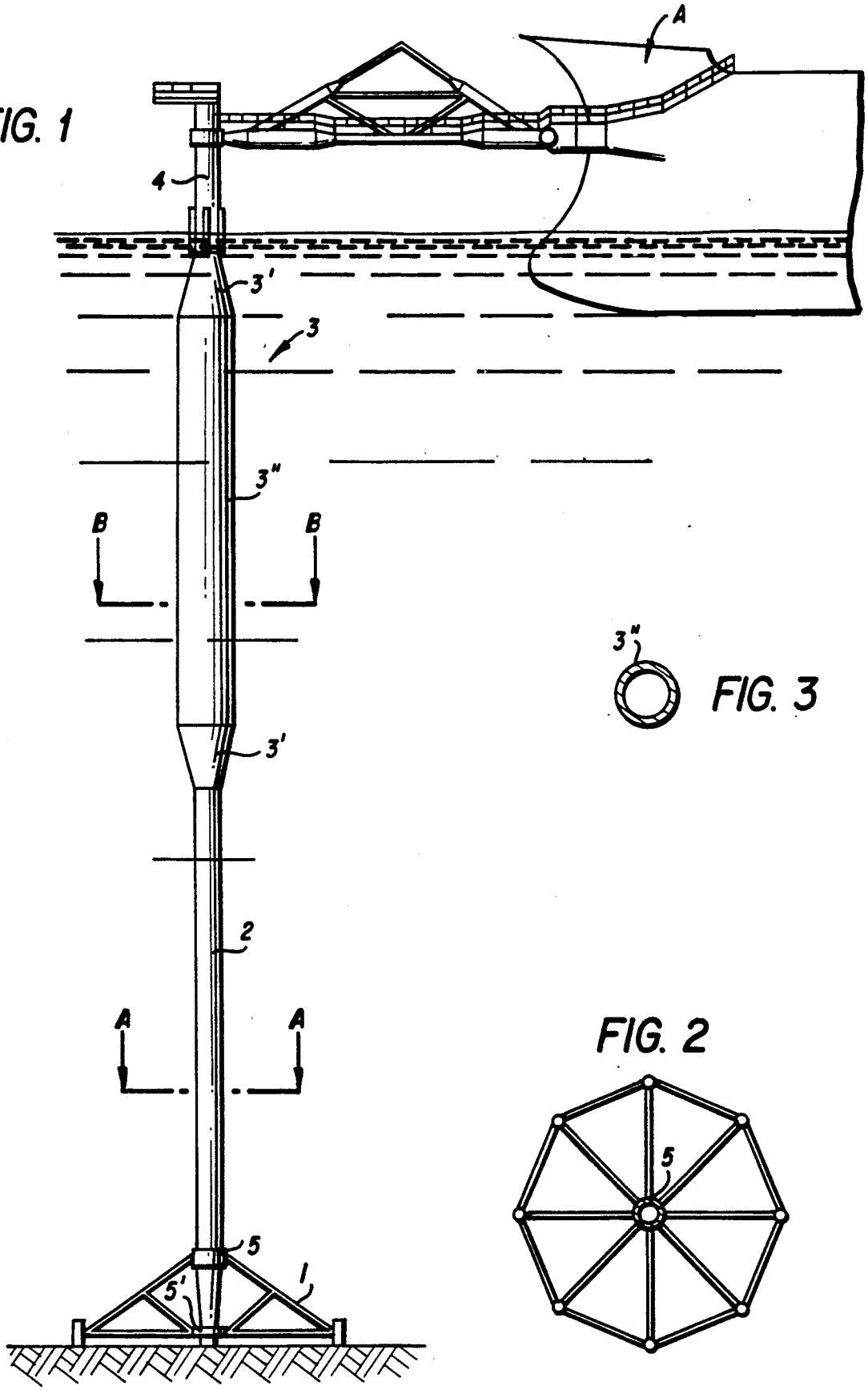
FIG. 1 is a schematic view in elevation of the column.
FIG. 2 is a transverse section of FIG. 1, in a plane passing through A—A.
FIG. 3 is a transverse section of FIG. 1, in a plane passing through B—B.

In the figures, and flexible column is represented for use in off-shore mooring, and suitable for a depth between 150 and 250 m, and made from a composite material consisting of glass fibers and unsaturated polyester resin, obtained by starting from bis-phenol A and fumaric acid, in a fiber/resin ratio between 40/60 and 60/40.

Glass fibers are partly arranged in parallel with the axis of the column, in the form of bundles of continuous monofilaments, partly wound helicoidally around the above-mentioned bundles.

With reference to the figures, to a rigid base (1) having a maximum width of 40 meters, a height of about 10-20 meters and a total weight of at least 1000 tons, the flexible column from composite material is constrained, which column consists of the hollow cylinder (2), the buoyance chamber (3), and the emerging structure (4).

The hollow cylinder (2), fastened to the base through the connection points (5) and (5'), has a diameter of 2-5 meters and a wall thickness of 100-300 mm, the thickness of which gradually increases towards the lower end. The buoyancy chamber (3) consisting of a cylinder (3'') to the ends of which two frustums of cone (3') are applied, has a length of about 50-100 meters, a diameter of 5-15 meters, and a wall thickness of 50-150 mm. The emerging structure (4) is 5-30 meters long and has a diameter of 1-10 meters, and a wall thickness of 100-300 mm. The buoyancy chamber (3) and the emerging structure (4) are made of the same composite material as the column.

As above mentioned, the column of the present invention may be used in different offshore fields. In the figures there is illustrated by exemplifying and not limitative purpose a mooring for an oil tanker (A) to carry out the usual oil cargo operations; in this case, inside the structure a water pipe is present (not illustrated in the figure) joined to the hauling shaft (also not illustrated) and in structure (4) commonly used systems for the distribution and regulation of the crude oil are provided.

The flexible column as above described may be used as a mooring for ships having a dead weight capacity up to 300,000 tons, and in a sea characterized by a significant wave height $H_s=9$ meters and average crossover period $T_z=9$ seconds.

What is claimed is;

1. In a column for use in offshore sea mooring application, said column being installed at a sea depth not exceeding 300 meters by means of a rigid base to which said column is constrained and said column being a monolith structure comprising a hollow cylinder, a buoyance chamber and an emerging structure, the improvement wherein the hollow cylinder, buoyancy chamber and emerging structure are made from a composite material of a thermosetting resin reinforced with fibers, said fibers being used in the form of unidirectional monofilament bundles, vertically arranged, without continuity and kept together by filaments helicoidally wrapped around them and said fibers consisting of natural fibers and artificial and synthetic fibers and said resin being selected from the group consisting of unsaturated polyester resins, epoxy resins, vinyl ester resins and polyurethane resins.

2. The column according to claim 1, wherein said column may be hollow or solid.

3. The column according to claim 1 or 2, wherein said column comprises in vertical ascending order a hollow cylinder, a bouyance chamber and an emerging structure, wherein the emerging structure contains instruments and devices to make the column functional.

4. The column according to claim 1 or claim 2, wherein the fiber/resin weight ratio is between 20/80 and 80/20, and preferably between 60/40 and 40/60.

5. The column according to claim 1 or claim 2, wherein the fiber is a glass fiber.

6. The column according to claim 1 or claim 2, wherein the external diameter is between 0.5 and 10 meters.

7. The column according to claim 1 or claim 2, wherein the column is an hollow column and the wall thickness is between 2 and 100 cm.

8. The column according to claim 1 or claim 2, wherein the buoyancy chamber has a wall thickness between 2 and 50 cm and an external diameter between 1.5-5 times the diameter of the column.

9. Flexible column according to claim 1 or claim 2, wherein the length is less than 300 meters.

* * * * *